United States Patent [19]

Barreto

[11] 3,936,515

[45] Feb. 3, 1976

[54] SLINGER MEANS FOR HUMIDIFIER

[75] Inventor: Juan Pablo Barreto, Barrie, Canada

[73] Assignee: General Electric Company, Bridgeport, Conn.

[22] Filed: Dec. 21, 1973

[21] Appl. No.: 427,147

[30] Foreign Application Priority Data

July 24, 1973 Canada ..... 177247

[52] U.S. Cl. ..... 261/29; 239/214.11; 239/218; 261/80; 261/92

[51] Int. Cl.[2] ..... B01F 3/04

[58] Field of Search ..... 261/92, 100, 30, 29, 80, 261/90, 83; 239/214.11, 214.13, 214.15, 214.17, 214.19, 214.21, 215, 218

[56] References Cited

UNITED STATES PATENTS

| | | | |
|---|---|---|---|
| 2,076,192 | 4/1937 | Carr | 261/90 |
| 2,076,660 | 4/1937 | Matteson et al. | 261/80 |
| 3,334,875 | 8/1967 | Hrapshaw | 261/29 |
| 3,637,194 | 1/1972 | Swimmer et al. | 261/92 X |
| 3,787,036 | 1/1974 | Hastings | 261/92 X |

*Primary Examiner*—Frank W. Lutter
*Assistant Examiner*—William Cuchlinski, Jr.
*Attorney, Agent, or Firm*—George R. Powers; Leonard J. Platt; John F. Cullen

[57] ABSTRACT

A slinger device for use in a humidifier liquid dispersion system includes blades having a main sloping section tilted in two planes relative to the rotational axis of the assembly and provided with flange means substantially co-extensive with at least one side edge whereby the outer edge of the flange means extends a constant distance from the axis of rotation.

8 Claims, 3 Drawing Figures

SLINGER MEANS FOR HUMIDIFIER

This invention relates generally to humidifiers and is more specifically directed to improvements in liquid slinger devices as employed in those humidifier systems which use a slinger-belt arrangement for dispersing liquid throughout an evaporative element located in a forced-air stream.

One of the major problems inherent in current slinger devices resides in providing a truly economical mechanism or structure capable of dispersing liquid onto an evaporative element with substantially even distribution. It has been considered to date that in order to obtain the desired distribution across the entire width of an evaporative element, at low rotational speeds, it was necessary to provide a slinger member with a plurality of axially staggered terminal points. The reasoning behind this stemmed from the fact that at low rotational speeds only the liquid thrown from the tips i.e. farthest points from the axis of rotation, has enough energy to the evaporative element. Naturally, to design a slinger having axially spaced "tips" not only increases manufacturing costs but also complicates static and dynamic balancing, and, in short, a compromise between the number of tips, costs and operating characteristics obviously leaves much to be desired.

It is further noted that current slinger members based on what may be termed the "staggered tip ejection" design, have an optimum operating high speed range which renders them unsatisfactory for humidifiers having provision for variable output, i.e. including low speed ranges.

The present invention provides a concept whereby a slinger device can be operated at various speeds and still effect liquid dispersion substantially throughout the entire working length of the evaporative element. Slinger devices embodying this novel concept are also symmetrical in all respects such that static and dynamic balancing is essentially no problem.

In brief, a slinger member according to the present invention includes fin elements of equal length diverging from the axis of rotation, with each fin element including flange means, the outer free edge of the flange means being parallel with the axis of rotation. By virtue of this construction, an ejection edge (or edges) is provided with each "point" on the edge being located at a fixed common radial distance from the center of rotation.

Figure 1:
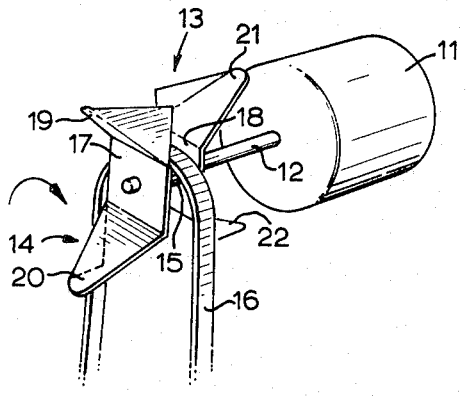
Figure 2:
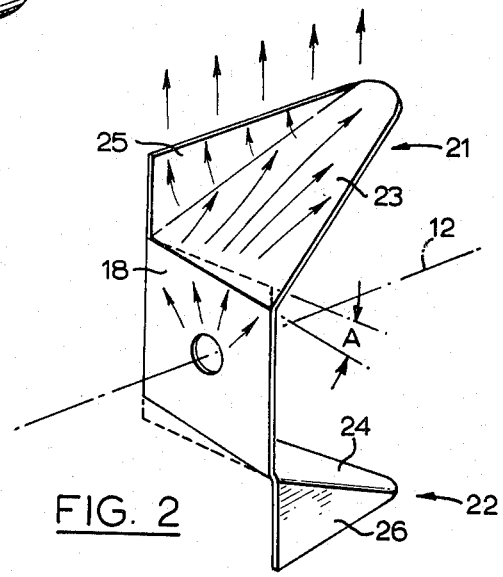
Figure 3:
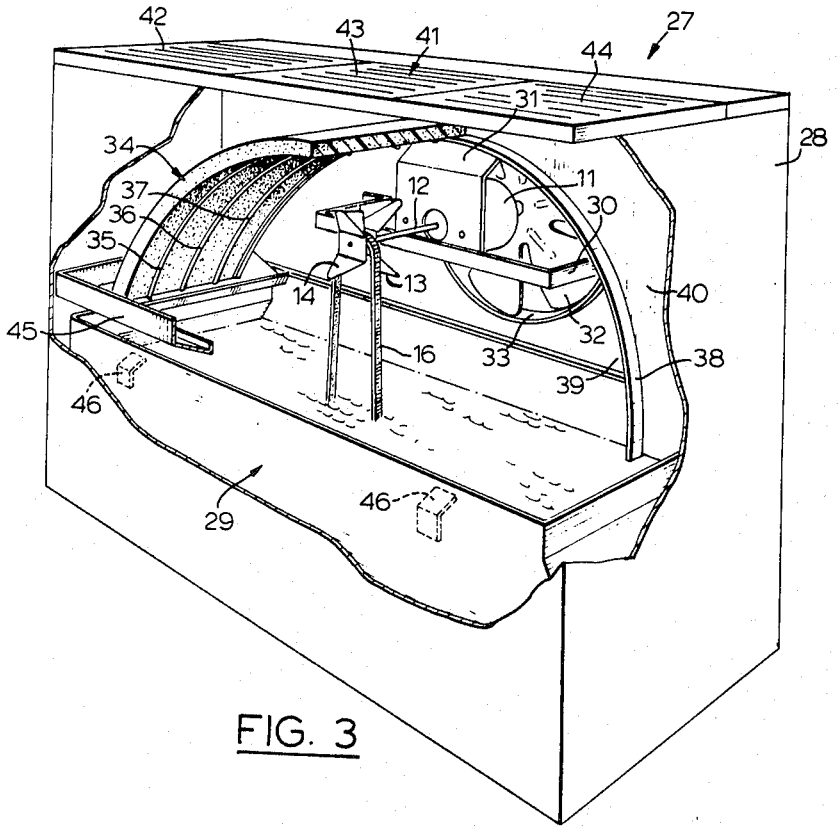

Further objects and advantages of the invention will be apparent from the following description taken in conjunction with the appended drawings wherein:

FIG. 1 is a perspective view of a preferred configuration of the new slinger-belt arrangement mounted on an axis of rotation, FIG. 2 is a perspective view of a single slinger member on a somewhat larger scale and provided with arrows indicating the flow of water when rotated, and FIG. 3 is a perspective view of a humidifier partially cut open to show the arrangement of the new slinger member therewithin.

In FIG. 1, there is shown a slinger-belt arrangement which includes an electromotor 11 having a horizontally extending drive shaft 12. Adjacent the free end of the drive shaft 12, two slinger members 13 and 14 are secured to the drive shaft 12 in back-to-back position and separated from each other by a spacer 15. A belt 16 lies loosely over the spacer 15 and extends downwardly into a water reservoir (not shown). Each slinger member includes a hub member 17 and 18 respectively withwhich it is mounted on the drive shaft 12 in a plane normal thereto and for rotation therewith. At least one pair of opposed fin members 19, 20 and 21, 22 respectively are connected to the hub member 17 and 18 respectively. As particularly shown in FIG. 2, each fin member extends from the hub member at a preselected angle relative to the drive shaft 12 and includes a base portion 23, 24, which forms an angled extension of the surface of the hub member 18. The base portion 23, 24 is additionally inclined about its longitudinally axis by an angle designated A in FIG. 2, i.e., the junction line between the hub member 18 and the base portion 23, 24 includes an angle other than 90° with respect to the free edges of the hub member. The fin member is further provided with flange means 25 and 26 respectively which are substantially coextensive with at least one side edge of the base portion and whose outer edge is at a constant distance from the axis of rotation of the drive shaft 12. The flange means 25, 26 may be located along the leading or trailing edges of the base portion 23, 24 which makes it possible to use identical slinger members in a back-to-back arrangement on the drive shaft 12.

When motor 11 is operating, water is transported from a water reservoir upwardly by the belt 16 and transferred to the slinger members 13 and 14 mainly by contact between the sides of the belt and the hub members 17 and 18. From the hub members the liquid is driven by the action of centrifugal surface tension and inertial forces towards the base portions 23, 24. Owing to the inclination of these base portions, most of the liquid has the tendency to flow up towards the flange means 25, 26 and then further up to the outer edge where it is thrown radially outwardly. Some of the liquid flows to the other free edge of the base portion where it is also thrown radially outwardly. This flow pattern is illustrated by arrows in FIG. 2. As pointed out before, all points on the outer edge of the flange means 25, 26 are located at a constant distance from the axis of rotation of the drive shaft 12. The result of this is that the centrifugal forces by which the liquid will be thrown away from the edge are exactly the same at every point of the edge thereby providing a uniform dispersion of the liquid along the entire edge regardless of the speed of rotation and so achieving the desired even distribution across an evaporative element.

It is obvious that the invention described can be achieved with different slinger configuration and is not necessarily restricted to the shape shown in FIG. 2. For example, the number of fin members can be increased from the two illustrated to 3, 4 or more symmetrically arranged around the hub member. Also the cross-sectional shape of the base portion of the fin member can be modified. The cross-section may be of angular or arcuate shape. In an effort to make the performance of the slinger less dependent on the surface conditions of the base portion, the base portion may be formed so that it is a portion of a conical surface. The liquid brought up by the belt on such conical surface will move in radial and axial directions, curving slightly toward the flange means due to the action of the inertial forces. The flange means is positioned in such a way that it gradually intercepts all of the liquid flowing on the base portion. When the liquid reaches the flange means, it moves up to the outer edge from where it is thrown radially outwardly. Less fit surface conditions brought on by the deposition of lime, for instance, which could somewhat impede the flow of the liquid on the base portion, are thereby overcome. Important is also here, of course, that every point of the outer edge of the flange means has the same distance from the axis of rotation.

A practical use of the above-disclosed slinger members is illustrated in FIG. 3 whereby the same numerals were employed for those parts already shown in FIGS. 1 and 2. A humidifier 27 which is cut open to permit a clear view of the arrangements in the interior, includes a cabinet 28 of preferably rectangular shape and a removable water reservoir 29 of drawer-like design and function located in the lower portion of the cabinet. The drawer-like reservoir 29 can be inserted and removed as necessary through an opening formed in the rear wall of the cabinet. The slinger-belt arrangement of FIG. 1 is mounted within the upper portion of the cabinet 28 by bracket means 30 and 31 which secure the motor 11 in a horizontal position and protect it from water spray during operation and water splash when the unit is being filled. The drive shaft 12 extends horizontally from both sides of the motor 11 whereby the rearwardly extending portion carries a fan blade 32. The fan blade 32 is positioned in front of an air inlet opening 33 which is provided in the rear wall of cabinet 28. The forwardly extending portion of the drive shaft 12 carries adjacent its end the slinger arrangement consisting of the slinger members 13 and 14 in back-to-back position and separated from each other by the spacer 15, and the belt 16 which lies loosely over the spacer 15 and extends downwardly into the water reservoir 29. The slinger-belt arrangement is partially enclosed or bridged by an evaporative element 34 shown herein in the form of an elongated band, preferably made of an open pore plastic foam, arching from one side over its top to the other side. The evaporative element 34 is supported by substantially arch-shaped rods 35, 36 and 37 and a flange 38 extending horizontally from the edge of a semicircular opening 39 formed in a baffle 40. The baffle 40 is positioned in the upper portion of the cabinet 28 parallel to its rear and front walls. If forms with the appropriate front and side wall portions of the cabinet an air duct means extending between the air inlet opening 33 and an air outlet opening 41. The air outlet opening 41 occupies a major part of the top wall of the cabinet 18 and is covered by louver assemblies 42, 43 and 44 of preferably square shape which have fixed slanting vanes. A splash guard 45 is connected to the front and side walls of the cabinet 28 slightly above the water reservoir 29 for redirecting excess water running down from the evaporative element 34 and the inside surfaces of the cabinet walls which are within the wetting range of the slinger members, into the water reservoir 29. The inner free edge of the splash guard 45 is turned upwardly forming a channel to collect the excess water and direct it to discharge outlets provided in the splash guard portion along the front wall of the cabinet 28 and adjacent each front corner. Underneath the discharge outlets and attached to the front wall of water reservoir 29 are located two collectors 46 which direct the water discharged from the splash guard 45 to the front wall of the water reservoir where it runs down quietly thus eliminating any dripping noise.

In operation, the motor 11 drives fan blade 32 which draws air through the air inlet opening 33 into the cabinet 28. The air enters through the semicircular opening 39 in baffle 40 the air duct means, is diverted upwardly and forced through the continuously wetted evaporative element 34. The incomming air picks up moisture from the water spray continuously filling the space beneath the evaporative element 34 and while passing through this element, and is then discharged through the louvers 42, 43 and 44 into the space to be humidified. The motor 11 drives also the slingers-belt arrangement whereby water is transported by the belt 16 upwards from the water reservoir 29 and distributively transferred onto the slinger members 13 and 14. As has been explicitly described in connection with the arrangements shown in FIGS. 1 and 2, most of the water flows up towards the flange means 25, 26 and then to the outer edge of the flange means where it thrown radially outwardly. Some of the water flows to the free edge of the base portion 23, 24 and is thrown off there. In this way an extensive and uniform wetting of the entire evaporative element 34 is achieved.

The embodiments of the invention in which an exclusive property or privilege is claimed are defined as follows:

1. A slinger device for use in a humidifer liquid dispersion system comprising a hub member mountable on a drive shaft in a plane normal thereto and for rotation therewith, and at least two divergent fin members connected to said hub member, said fin members symmetrically arranged around said hub member and each of the fin members including a base portion forming an angled extension of the surface of said hub member, said base portion inclined outwardly from said hub member relative to said drive shaft at an angle selected to cause liquid to flow outward along said base portion when said hub member is rotated by said drive shaft, each of the fin members further including flange means substantially coextensive with at least one side edge of said respective base portion, the outer edge of each flange means extending at a constant distance from the axis of rotation of said drive shaft.

2. The slinger device as defined in claim 1 wherein the base portion of said fin member is additionally inclined about its longitudinal axis such that the angle between the edges of the hub member and the junction line between hub member and base portion is other than 90°.

3. The slinger device as defined in claim 1 wherein the cross-section of said base portion is of angular shape.

4. The slinger device as defined in claim 1 wherein the cross-section of said base portion is of arcuate shape.

5. The slinger device as defined in claim 4 wherein the arcuate-shaped cross-section is such that the surface of said base portion defines a portion of a conical surface.

6. In a humidifier comprising a housing, a water reservoir occupying the lower portion of said housing, air inlet and outlet openings in the upper portion of said housing, air duct means formed within the upper portion of said housing and an evaporative element supported therein, drive means in the form of an electromotor located in the upper portion of said housing to power means for providing an air flow from said air inlet opening through said evaporative element to said air outlet opening, the drive shaft of said motor extending horizontally from both sides of the motor towards said air inlet opening and said air duct means respectively, said means providing an air flow including fan blade means mounted on that end of said drive shaft extending toward air inlet opening, and a slingerbelt arrangement including at least one slinger device mounted on that end of said drive shaft extending toward said air duct means for supplying water from said reservoir to said evaporative element, said slinger device including a hub member mountable to said drive shaft in a plane normal thereto, at least two divergent fin members connected to said hub member and each having a base portion forming an angled extension of the surface of said hub member inclined outwardly from said hub relative to said drive shaft at an angle selected to cause liquid to flow outward along said base portion when said hub member is rotated by said drive shaft, said base portion also being inclined about its longitudinal axis such that the angle between the edges of said hub member and the junction line between hub member and base portion is other than 90°, and flange means substantially coextensive with at least one side edge of said base portion, the outer edge of said flange means extending substantially parallel to the axis of rotation of said drive shaft.

7. A humidifier as defined in claim 6 wherein said slinger-belt arrangement includes two slinger devices having fin members displaying base portions with an arcuate-shaped cross-section such that the surface of said base portions define part of a conical surface, said slinger devices being disposed on said drive shaft in tandem and connected to each other in back-to-back relationship but separated from each other by a spacer and a slinger belt lying loosely over said spacer and extending into said water reservoir.

8. A humidifier as defined in claim 7 wherein said flanges means are positioned such that they gradually intercept all of the water supplied by said belt and flowing on said base portions.

* * * * *

UNITED STATES PATENT OFFICE

CERTIFICATE OF CORRECTION

PATENT NO. : 3,936,515

DATED : February 3, 1976

INVENTOR(S) : Juan Pablo Barreto

It is certified that error appears in the above-identified patent and that said Letters Patent are hereby corrected as shown below:

First printed page -"Assignee: General Electric Company
Bridgeport, Conn."

should be - "Assignee: Canadian General Electric Company, Limited
Toronto, Ontario
Canada"

Signed and Sealed this

*twenty-fifth* Day of *May 1976*

[SEAL]

*Attest:*

RUTH C. MASON
*Attesting Officer*

C. MARSHALL DANN
*Commissioner of Patents and Trademarks*